United States Patent [19]

Minami

[11] 4,083,089

[45] Apr. 11, 1978

[54] SLIDING CLASP FASTENER

[75] Inventor: Tadashi Minami, Kurobe, Japan

[73] Assignee: Yoshida Kogyo Kabushiki Kaisha, Japan

[21] Appl. No.: 678,982

[22] Filed: Apr. 21, 1976

[30] Foreign Application Priority Data

Apr. 24, 1975 Japan ..... 50-56122[U]

[51] Int. Cl.[2] ..... A44B 19/34

[52] U.S. Cl. ..... 24/205.16 R; 190/41 Z

[58] Field of Search ..... 24/205.16 R, 205.16 C, 24/205 R; 190/41 Z; 2/265

[56] References Cited

U.S. PATENT DOCUMENTS

| | | | |
|---|---|---|---|
| 2,035,593 | 3/1936 | Coventry | 190/41 Z |
| 2,200,428 | 5/1940 | Ostwald | 24/205.16 R |
| 2,255,183 | 9/1941 | Ostwald | 24/205.16 R |
| 2,658,543 | 11/1953 | Budnick | 24/205.16 R |
| 4,009,505 | 3/1977 | Takamatsu | 24/205 R |

FOREIGN PATENT DOCUMENTS

| | | | |
|---|---|---|---|
| 992,950 | 10/1951 | France | 24/205.16 R |
| 6,608,885 | 12/1967 | Netherlands | 24/205 R |

*Primary Examiner*—Bernard A. Gelak

*Attorney, Agent, or Firm*—Bucknam and Archer

[57] ABSTRACT

A sliding clasp fastener having an adapter web member capable of attaching the fastener to a more rigid material than a stringer tape of the fastener. A pair of fastener stringers each have a stringer tape carrying on and along one longitudinal edge a row of interlocking elements, the other longitudinal edge of the tape being formed with a bulged portion extending therealong. The adapter web member is carried on the bulged edge portion of at least one of the fastener stringers for mounting the sliding clasp fastener on the rigid material. The adapter web member has a first longitudinal edge fixed in surrounding relation to the bulged edge portion and a second longitudinal edge adapted for attachment to the rigid material, the first and second edges each having recesses formed therein at spaced locations along the length thereof.

3 Claims, 6 Drawing Figures

SLIDING CLASP FASTENER

BACKGROUND OF THE INVENTION

1. Field of the Invention

This invention relates to sliding clasp fasteners, and more particularly concerns a sliding clasp fastener having adapter means capable of mounting the fastener on rigid material.

2. Description of the Prior Art

Sliding clasp fasteners used on flexible articles such as garments or bags are easily attached thereto with sewing stitches. However, when the fastener is to be secured to suitcases or chairs which are made of more rigid material such as metal or plastics than the stringer tapes of the fastener, the sewing stitches can no longer be used for attachment purposes.

One common form of sliding clasp fastener capable of being attached to such rigid material comprises a metal or plastics web member fixed along one edge to an element-free edge of the fastener stringer tape, the web member being attached along the other edge to the riged material by means of welding or riveting. However, the mounted web member renders the overall fastener structure less flexible and thus, the resultant fastener can not be bent exactly to the curved shape of an article such as a chair or suitcase.

SUMMARY OF THE INVENTION

With the prior art deficiency in view, it is an object of the present invention to provide a sliding clasp fastener with an adapter web member capable of attaching the fastener to a rigid material and yet retaining the flexibility of the fastener.

Briefly stated, adapter means is mounted on a bulged edge portion of a fastener stringer for attaching the fastener to rigid material. The adapter means comprises a web member having a first longitudinal edge fixed in surrounding relation to the bulged edge portion and a second longitudinal edge for attachment to the rigid material. The first and second edges are each provided with recesses formed therein at spaced locations along the length thereof.

Other objects and advantages of the invention will become apparent as the following specification progresses, reference being had to the accompanying drawing which illustrates preferred embodiments of the invention.

DESCRIPTION OF THE PREFERRED EMBODIMENTS

Figure 1:
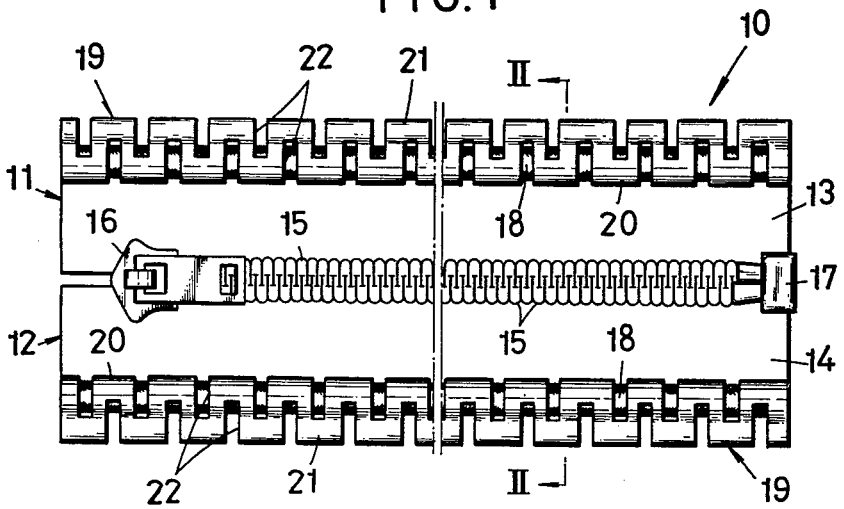
FIG. 1 is a plan view of a sliding clasp fastener constructed in accordance with the invention.

Referring to FIG. 1, there is shown a sliding clasp fastener generally designated at 10 and comprising a pair of oppositely disposed stringers 11, 12 having a pair of stringer tapes 13, 14, respectively, each carrying on and along one longitudinal edge a row of interlocking elements 15. Each of the fastener stringer tapes 13, 14 is made of a flexible material such as a woven or warp knit fabric, for example. The interlocking fastener elements 15 are herein shown to be helically coiled elements, but may be meandering or discrete elements.

The fastener 10 further includes a slider 16 mounted on and movable along the rows of coupling elements 15 to couple and uncouple the same, and a bottom end stop 17 of the usual box-and-pin type for restricting thereat the downward movement of the slider 16 when the latter is manipulated to open the fastener 10.

According to an important aspect of the invention, each of the fastener tapes 13, 14 is formed along the other longitudinal edge or element-free edge with a bulged portion 18 of substantially circular cross-section. The bulged portion 18 carries thereon an adapter web member 19 extending along the entire length thereof. The web member 19 is made of metal or plastics and has an inner or first longitudinal edge portion 20 fixed in surrounding relation to the bulged edge portion 18 and an outer or second longitudinal edge portion 21 adapted for attachment to an article such as a chair or suitcase made of more rigid material than the fastener tapes 13, 14. Each of the inner and outer longitudinal edges 20, 21 has recesses 22 formed therein at spaced locations along the length thereof. The recesses 22 in the inner and outer edges 20, 21 are staggered relative to each other in the longitudinal direction of the web member 19.

Figure 2:
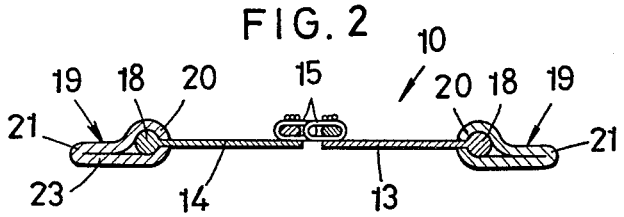
FIG. 2 is a transverse cross-sectional view taken along line II—II of FIG. 1.

As shown in FIG. 2, the web member 19 is formed of an elongate sheet 23 folded on itself about its longitudinal central axis. The folded sheet 23 is placed with its opposite free edges held astride of the bulged edge portion 18 and is pressed in a direction perpendicular to the plane thereof so that the opposite free edges of the folded sheet 23 will clamp the bulged edge portion 18 in place. Alternatively, the web member 19 is formed on the bulged edge 18 by injection-molding a suitable plastics material.

With the disclosed structure, the web member 19 is given much flexibility because of the recesses 22 formed therein and the sliding clasp fastener 10 with the web members 19 thereon can retain its flexibility and is bendable in any direction into conformity with the curved shape of an article to which the fastener 10 is to be attached.

Figure 3:
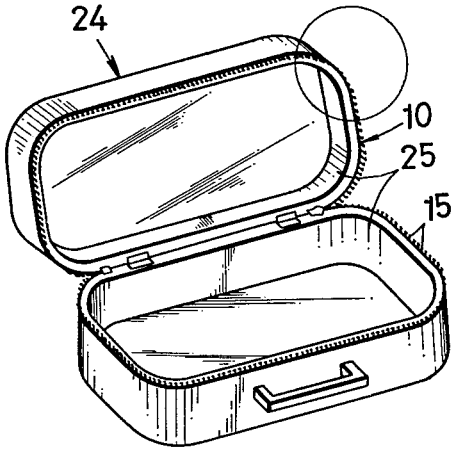
FIG. 3 is a perspective view of a suitcase having the sliding clasp fastener shown in FIG. 1.
Figure 4:
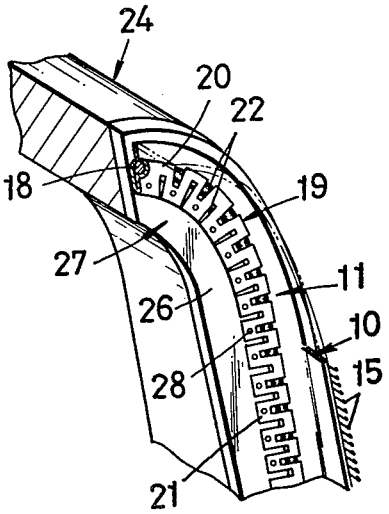
FIG. 4 is an enlarged fragmentary perspective view, partially cut away, of a corner of the suitcase such as shown in a circle line of FIG. 3.

FIGS. 3 and 4 illustrate an example in which the sliding clasp fastener 10 of the invention is attached to a suitcase 24 made of rigid material such as metal or plastics. The fastener stringers 11, 12 are bent to the curved profile of side walls 25 and affixed to confronting surfaces 26 of metal edge 27 by reveting at 28 or otherwise welding the outer edges 21 of the web members 19 to the metal edges 27.

Figure 5:
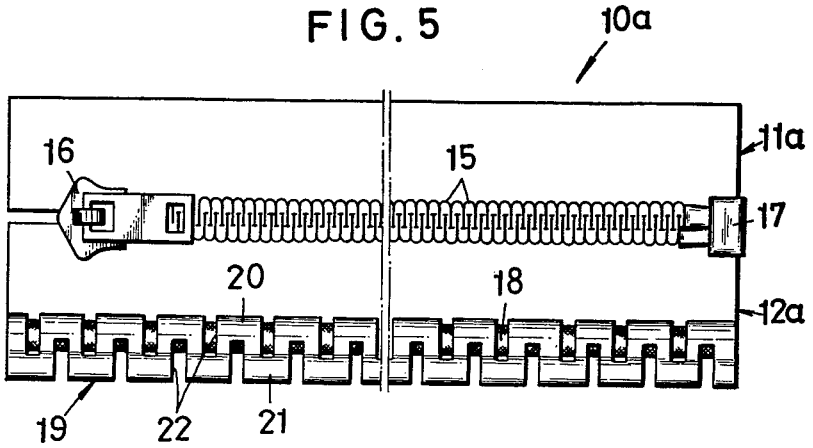
FIG. 5 is a plan view illustrative of a modified sliding clasp fastener of the invention.
Figure 6:
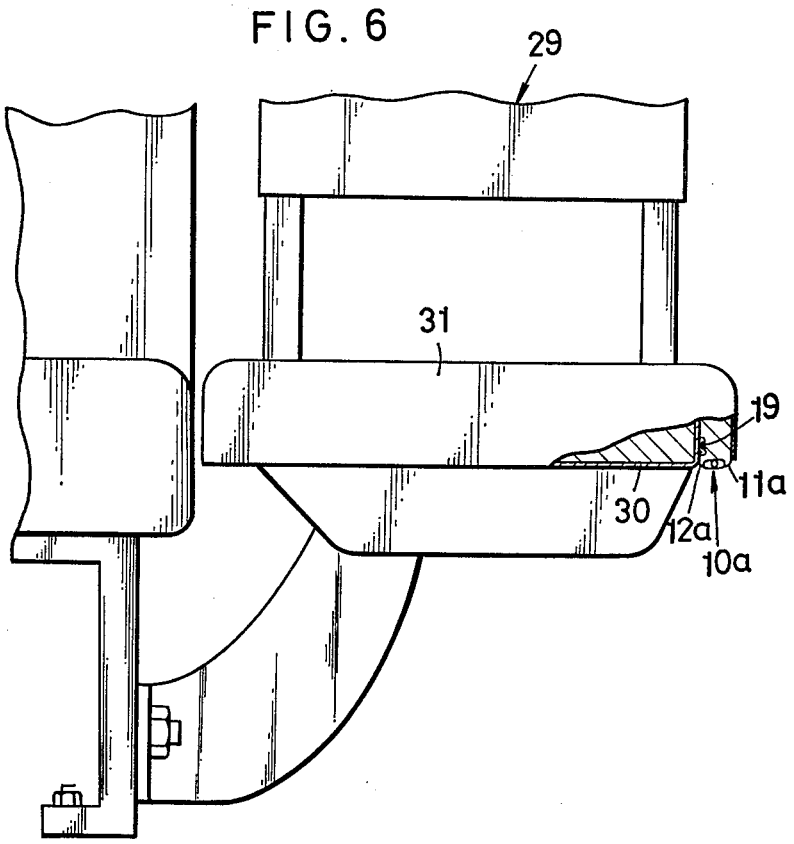
FIG. 6 is a fragmentary front elevational view of a chair utilizing the fastener shown in FIG. 5.

A modified sliding clasp fastener **10*a* shown in FIG. 5 is devoid of one of the web members 19 and is suitable for use on a chair 29 in which a seat 30 is to be upholstered by a flexible sheet 31. More specifixally, as shown in FIG. 6, the fastener stringer 11*a* which is devoid of the web member 19 is attached to a marginal edge of the sheet 31 by usual sewing stitches and the fastener stringer 12*a* having mounted thereon the web member 19 is bent in conformity with a curved surface of the seat 30 and fixed thereto by means of riveting or welding, as the case may be. The sliding clasp fastener 10*a* is then closed by the slider 16 to thereby connect the sheet 31 with the seat 30**.

Although the present invention has been shown and described with reference to specific embodiments thereof, numerous changes and modifications falling within the scope of the appended claims are possible.

What I claim as my invention:

1. A sliding clasp fastener comprising in combination: a pair of fastener stringers each having an elongated stringer tape carrying on and along one longitudinal edge a row of interlocking fastener elements, the other longitudinal edge of at least one stringer tape having a bulged portion extending therealong; a slider mounted on and movable along said rows of interlocking fastener elements to couple and uncouple the same; and an elongated adapter web member carried on said bulged edge portion of at least one of said stringer tapes for mounting the sliding clasp fastener on a support material, said adapter web member having inner edge portions which embrace said bulged edge portion to secure thereto the adapter web member, said adapter web member having outer edge portions disposed for attachment to said support material, said inner and outer edge portions having recesses disposed at spaced locations along the lengths of said edge portions and said recesses in the inner and outer edge portions being staggered relative to each other in the longitudinal direction of said web member.

2. A sliding clasp fastener comprising in combination: a pair of fastener stringers each having an elongated stringer tape carrying on and along one longitudinal edge a row of interlocking fastener elements, the other longitudinal edge of at least one stringer tape having a bulged portion extending therealong; a slider mounted on and movable along said rows of interlocking fastener elements to couple and uncouple the same; and an elongated adapter web member carried on such bulged edge portion of at least one of said stringer tapes for mounting the sliding clasp fastener on a support material, said adapter web member having inner edge portions which embrace said bulged edge portion to secure thereto the adapter web member, said adapter web member having outer edge portions disposed for attachment to said support material, said adapter web member being an elongate sheet folded on itself about its longitudinal central axis with the opposite free edges clamping said bulged edge portion in place.

3. A sliding clasp fastener comprising in combination: a pair of fastener stringers each having an elongated stringer tape carrying on and along one longitudinal edge a row of interlocking fastener elements, the other longitudinal edge of at least one stringer tape having a bulged portion extending therealong; a slider mounted on and movable along said rows of interlocking fastener elements to couple and uncouple the same; an elongated adapter web member carried on said bulged edge portion of at least one of said stringer tapes for mounting the sliding clasp fastener on a support material, said adapter web member having inner edge portions which embrace said bulged edge portion to secure thereto the adapter web member, said adapter web member having outer edge portions disposed for attachment to said support material, said inner edge portions being in longitudinally spaced-apart separated relation to one another to embrace said bulged edge portion at a corresponding plurality of longitudinally spaced-apart, separated locations, and said outer edge portions being in longitudinally spaced-apart separated relation to one another, said spacing and separation of said inner and outer said portions establishing an adapter web member configuration having a given flexibility.

* * * * *